US008112836B2

(12) United States Patent
Tesar et al.

(10) Patent No.: US 8,112,836 B2
(45) Date of Patent: Feb. 14, 2012

(54) POSITIONING MECHANISM OF A BED

(75) Inventors: Milan Tesar, Slany (CZ); Vladmir Kolar, Slany (CZ)

(73) Assignee: Linet spol. s.r.o., Slany (CZ)

( * ) Notice: Subject to any disclaimer, the term of this patent is extended or adjusted under 35 U.S.C. 154(b) by 0 days.

(21) Appl. No.: 12/867,166

(22) PCT Filed: Feb. 12, 2009

(86) PCT No.: PCT/CZ2009/000015

§ 371 (c)(1),
(2), (4) Date: Aug. 11, 2010

(87) PCT Pub. No.: WO2009/100692

PCT Pub. Date: Aug. 20, 2009

(65) Prior Publication Data

US 2011/0010858 A1 Jan. 20, 2011

(30) Foreign Application Priority Data

Feb. 15, 2008 (CZ) ..... 2008-19673

(51) Int. Cl.

| | |
|---|---|
| ***A47B 7/02*** | (2006.01) |
| ***A47B 7/00*** | (2006.01) |
| *A47B 71/00* | (2006.01) |
| *A47F 5/12* | (2006.01) |

(52) U.S. Cl. ..... 5/608; 5/607; 5/610; 5/611; 5/600; 108/7; 108/4; 108/1

(58) Field of Classification Search ..... 5/600, 607, 5/608, 610, 611, 943; 108/1–10
See application file for complete search history.

(56) References Cited

U.S. PATENT DOCUMENTS

| | | | |
|---|---|---|---|
| 4,600,066 | A | 7/1986 | Griffen |
| 4,926,951 | A | 5/1990 | Carruth |
| 4,934,468 | A | 6/1990 | Koerber, Sr. |
| 4,953,244 | A | 9/1990 | Koerber, Sr. |
| 4,961,470 | A | 10/1990 | Koerber, Sr. |
| 4,974,692 | A | 12/1990 | Carruth |
| 5,173,977 | A | 12/1992 | Carruth |
| 5,279,010 | A | 1/1994 | Ferrand |
| 5,393,938 | A | 2/1995 | Bumbalough |
| 5,664,270 | A | 9/1997 | Bell |
| 5,672,849 | A | 9/1997 | Foster |
| 5,771,511 | A | 6/1998 | Kummer |
| 5,802,640 | A | 9/1998 | Ferrand |
| 5,859,390 | A | 1/1999 | Stafford |
| 5,906,916 | A | 5/1999 | Wu |
| 6,067,019 | A | 5/2000 | Scott |
| 6,208,250 | B1 | 3/2001 | Dixon |
| 6,438,776 | B2 | 8/2002 | Ferrand |

(Continued)

*Primary Examiner* — Jonathan Liu

(74) *Attorney, Agent, or Firm* — Nelson Mullins Riley & Scarborough LLP

(57) ABSTRACT

A positioning mechanism of a bed comprising height adjustable lifters that are mounted between the undercarriage and patient surface frame. The first lifter is arranged so that its axis intersects the longitudinal axis of the frame. The first lifter is connected to frame oscillatingly around the longitudinal axis of the frame and in a sliding way in the direction of the longitudinal axis of the frame. The second and the third lifters are interconnected with an arm, oriented transversally to the longitudinal axis. The arm is oscillatingly connected to the frame and is connected at one end to the second lifter both oscillatingly around an axis, in parallel with the longitudinal axis of the frame and in a sliding way transversally to the frame. The other end the arm is connected to the third lifter, oscillatingly around the axis, in parallel with the longitudinal axis of the frame.

3 Claims, 3 Drawing Sheets

U.S. PATENT DOCUMENTS

| | | | |
|---|---|---|---|
| 6,493,568 | B1 | 12/2002 | Bell |
| 6,566,833 | B2 | 5/2003 | Bartlett |
| 6,680,443 | B2 | 1/2004 | Dixon |
| 6,718,572 | B2 | 4/2004 | Schroeter |
| 6,791,460 | B2 | 9/2004 | Dixon |
| 6,822,571 | B2 | 11/2004 | Conway |
| 6,877,178 | B2 | 4/2005 | Chapman |
| 6,924,441 | B1 | 8/2005 | Mobley |
| 6,978,501 | B2 | 12/2005 | Vrzalik |
| 7,176,391 | B2 | 2/2007 | Metz |
| 7,232,962 | B2 | 6/2007 | Rynd |
| 7,253,366 | B2 | 8/2007 | Bhai |
| 7,282,652 | B1 | 10/2007 | Johnson |
| 7,296,312 | B2 | 11/2007 | Menkedick |
| 7,335,839 | B2 | 2/2008 | Metz |
| 7,426,760 | B2 | 9/2008 | Vrzalik |
| 7,437,787 | B2 | 10/2008 | Bhai |
| 7,459,645 | B2 | 12/2008 | Skinner |
| 7,500,280 | B2 | 3/2009 | Dixon |
| 7,520,006 | B2 | 4/2009 | Menkedick |
| 7,557,718 | B2 | 7/2009 | Petrosenko |
| 7,568,246 | B2 | 8/2009 | Weismiller |
| 2001/0029628 | A1 | 10/2001 | Ferrand |
| 2003/0079289 | A1 | 5/2003 | Vrzalik |
| 2006/0090261 | A1 | 5/2006 | Vrzalik |
| 2006/0277683 | A1 | 12/2006 | Lamire |
| 2008/0289107 | A1 | 11/2008 | Vrzalik |

POSITIONING MECHANISM OF A BED

CROSS-REFERENCE TO RELATED APPLICATIONS

This application is the national phase, under 35 USC §371, of International Application No. PCT/CZ2009/000015, filed Feb. 12, 2009, which claimed priority to Czech Republic Application No. PUV 2008-19673 filed Feb. 15, 2008. The present application claims the benefit of priority to and incorporates herein by reference, in their entirety, the disclosures of International Application No. PCT/CZ2009/000015 and Czech Republic Application No. PUV 2008-19673.

TECHNICAL FIELD

The invention relates to a positioning mechanism of a bed comprising at least two height adjustable lifters arranged in a distance from each other that are mounted on the undercarriage frame at one side and connected to the patient surface frame at the other side.

BACKGROUND ART

Within the care of lying patients it is advantageous if the hospital bed enables side tilt of the patient surface of the bed besides other positions. For therapeutic purposes a min. ±30° side tilt is required. However, at such tilt there is a problem of collision of individual parts of the patient surface with the undercarriage. To prevent a collision, it is usually necessary to lift the bed horizontally and only then it can be tilted sideways. Therefore, known tilting mechanisms usually raise the lowest possible position of the patient surface in the horizontal position. For these reasons the used electronic installation is relatively complicated and the absolute position of the height of the patient surface must be sensed and collision statuses must be evaluated.

So far, for the height adjustment of patient surfaces of tilting and positioning hospital beds mostly linear telescopic systems with two or four lifters have been used. The use of more than two telescopic extensible lifters to control the height of the patient surface and its further positioning brings problems in the possibility of the mechanisms colliding in some positions.

Another disadvantage of this design is structural complexity and the resulting high investment demands of the existing tilting and positioning beds.

Another disadvantage of known solutions is the problematic combination of setting the side tilt and Trendelenburg and anti-Trendelenburg position, i.e. tilting the patient surface around the transversal axis.

Therefore, the goal of the invention is to design such a positioning mechanism of a bed that minimizes the above mentioned shortcomings.

DISCLOSURE OF INVENTION

The above mentioned goal is achieved with a positioning mechanism of a bed comprising at least two height adjustable lifters arranged in a distance from each other that are mounted on the undercarriage frame at one side and connected to the patient surface frame at the other side, in accordance with a invention the principle of which consists in the fact that the first lifter is arranged in such a way that its axis intersects the longitudinal axis of the patient surface frame and the first lifter is connected to the patient surface frame in a swinging way around the longitudinal axis of the patient surface frame and in a sliding way in the direction of the longitudinal axis of the patient surface frame. The second lifter and the third lifter are interconnected with an arm, oriented transversally to the longitudinal axis of the patient surface frame and the arm is connected to the patient surface frame in a swinging way. The arm is connected at one end to the second lifter both in a swinging way around the axis, in parallel with the longitudinal axis of the patient surface frame and in a sliding way transversally to the patient surface frame. At the other end the arm is connected to the third lifter, in a swinging way around the axis, in parallel with the longitudinal axis of the patient surface frame.

Such a design of the positioning mechanism of a bed reduces stressing of the lifters by horizontal components of the load, minimizes the installation height of the mechanism, makes it possible to tilt the patient surface frame from the bottom position of the lifters already as there is no danger of collision of the patient surface frame with the undercarriage frame.

In a beneficial embodiment the first lifter at its top end carries at least one horizontal first guide in which the first slider is mounted in a sliding way. The first slider is connected to a yoke in a swinging way while the yoke is connected to the patient surface frame in a swinging way. The second lifter carries at its top end at least one second guide in which at least one second slider is mounted in a sliding way that is connected with a pin to one end of the arm while the third lifter is connected to the opposite end of the arm with a pin.

In accordance with a preferred embodiment the distance between the axes of the pins arranged at the opposite ends of the arm is bigger than the distance between the longitudinal axes of the second and third lifter. This version reduces vertical forces loading the lifter during side loading of the patient surface, especially in case of a lateral tilt.

To facilitate movement control under the undercarriage frame and patient surface frame position sensors with an opposite cam are arranged. The use of such simple end sensors for the control of the zero position and the maximum tilt replaces complicated position measurements of each lifter.

BRIEF DESCRIPTION OF DRAWINGS

The positioning mechanism of a bed in accordance with the invention will be described in a more detailed way with the use of a sample of a particular embodiment illustrated in the attached drawings where individual figures show.

MODES FOR CARRYING OUT THE INVENTION

Figure 1:
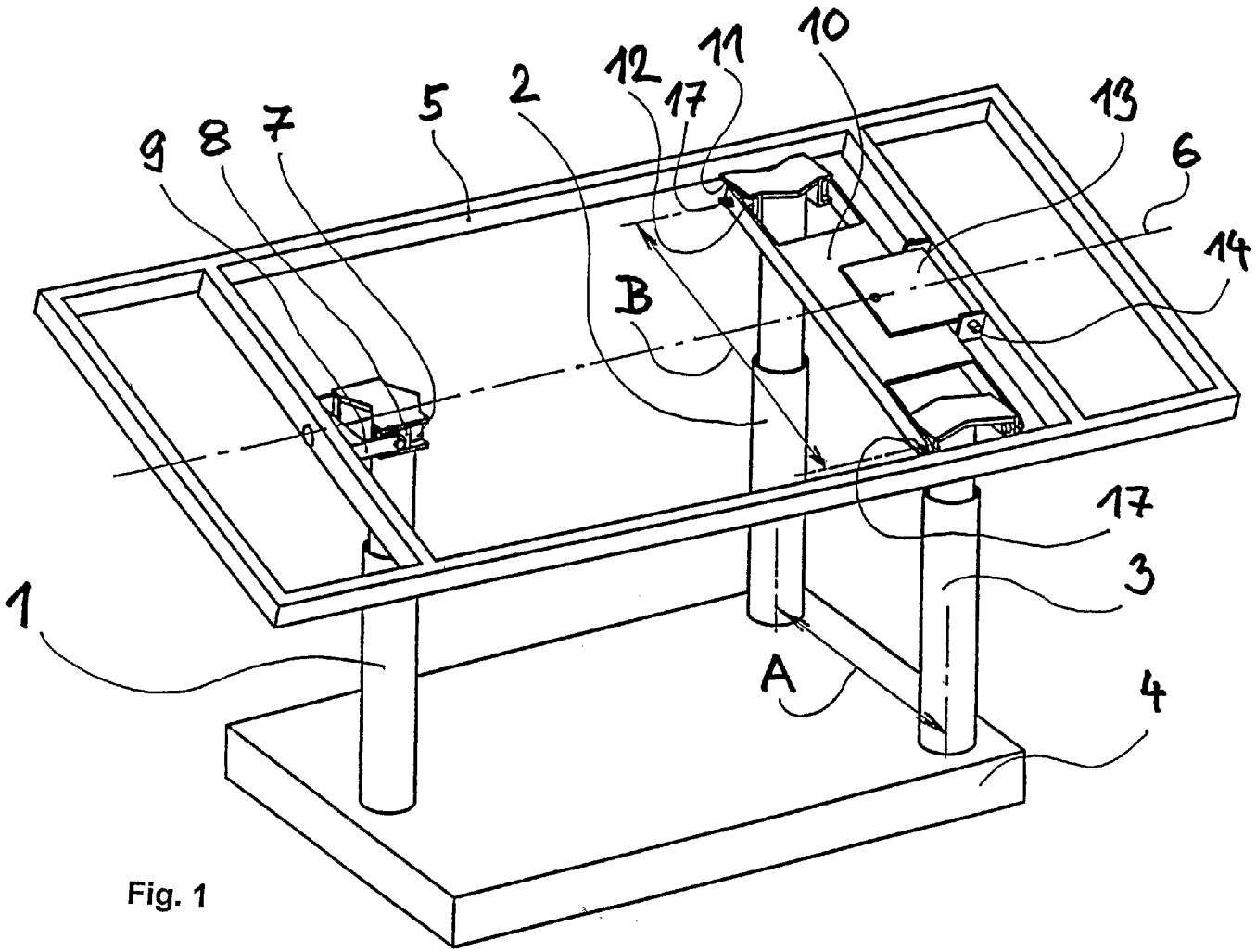
FIG. 1 is a schematic drawing of the positioning mechanism of a bed
Figure 2:
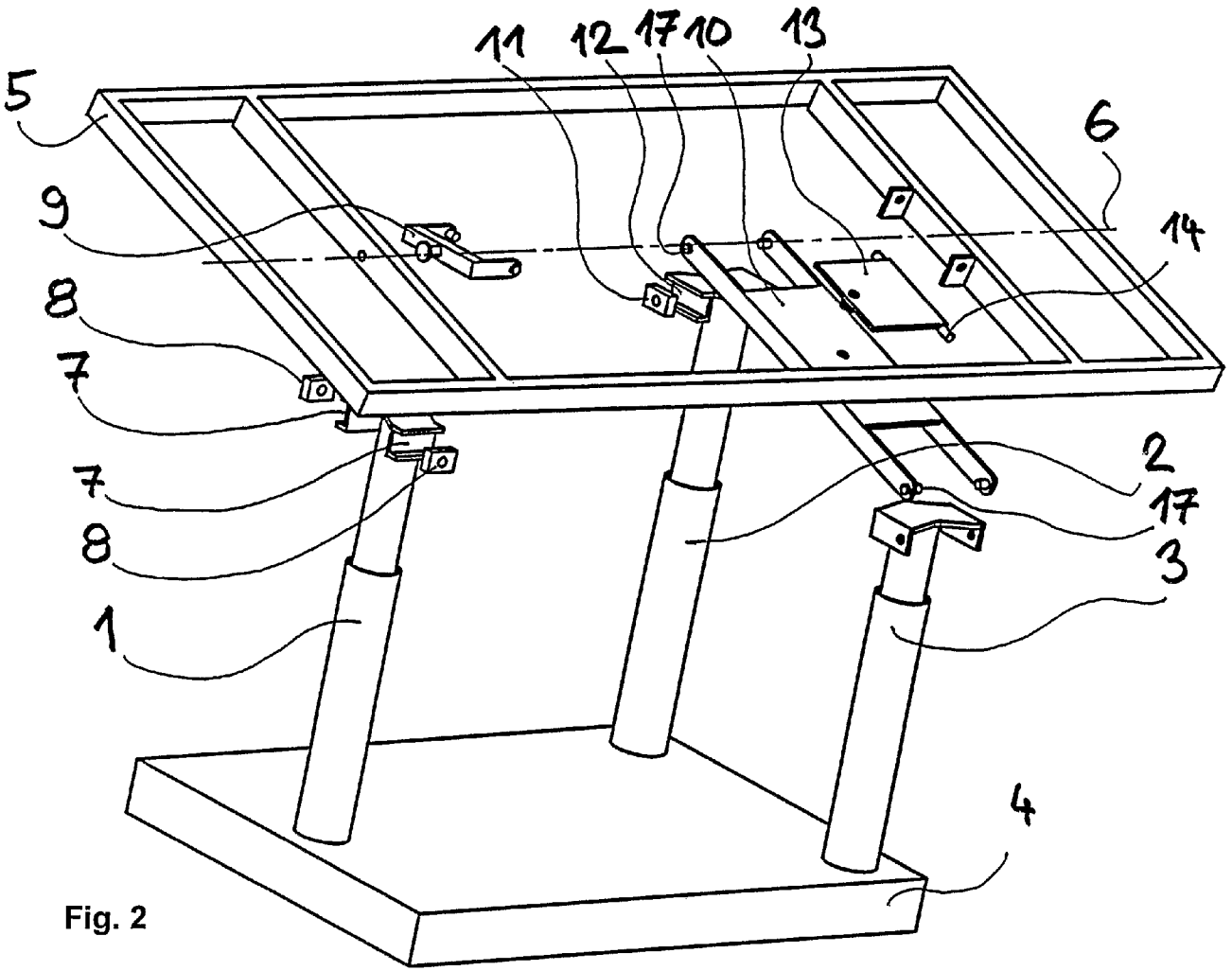
FIG. 2 shows the positioning mechanism from FIG. 1 in an expanded view

FIGS. 1 and 2 show a sample embodiment of the positioning mechanism of a bed in accordance with the invention comprising three height adjustable lifters 1, 2, 3 that are mounted on the undercarriage frame 4 at one side and at the other side are connected to the frame 5 of the patient surface of the bed.

The lifters 1, 2, 3 are height adjustable with the use of electric motors that are not shown here.

The lifters 1, 2, 3 can have any design know from the art. As an example the telescopic lifter described in the utility model no. CZ6654 can be mentioned.

The first lifter 1 is arranged on the undercarriage frame 4 vertically in such a way that the axis of the first lifter 1 intersects the longitudinal axis 6 of the patient surface frame 5. The first lifter 1 carries at its top end two horizontal first guides 7 in which two first sliders 8 are mounted in a sliding way. The first two sliders 8 are connected in a swinging way with the use of pins to the opposite arms of the yoke 9 that is connected to the frame 5 of the patient surface in such a way that it can swing around the longitudinal axis 6 of the patient surface frame 5.

The second lifter 2 and the third lifter 3 are interconnected with an arm 10 oriented transversally to the longitudinal axis 6 of the patient surface frame 5.

The second lifter 2 carries at its top end two second guides 12 in which two second sliders 11 are mounted in a sliding way while the sliders 11 are connected in a swinging way to one end of the arm 10 and the third lifter 3 is connected to the opposite end of the arm 10 with a pin.

In the middle, arm 10 is connected with the use of a plate and a shaft 14 to the patient surface frame 5 while the shaft 14 is oriented transversally to the longitudinal axis 6 of the patient surface frame 5.

The arm 10 is connected to the top end of the second and third lifter 2, 3 in such a way that the distance B between the axes of the pins 17 arranged at the opposite ends of the arm 10 is bigger than the distance A between the longitudinal axes of the second and third lifter 2, 3. It is not usually possible to increase the axial distances A of the lifters as during a side tilt of the patient surface frame 5 a collision with the undercarriage frame 4 would occur. The more the distance B between the axes of the pins 17 approximates the width of the patient surface frame 5, the smaller is the danger that during a side tilt the patient surface frame 5 will collide with the undercarriage frame 4.

On the patient surface frame 5 four position sensors 15 are installed against which a cam 16 is mounted. The position sensors 15 are common end sensors.

Depending on the mutual extension and retraction of individual lifters 1, 2, 3 the frame 5 of the patient surface can be raised, lowered and tilted both around the transversal axis and around the longitudinal axis 6.

To achieve transversal tilt of the patient surface frame 5 around the longitudinal axis 6 the second lifter 2 and the third lifter 3 are put in counter-motion.

Figure 3:
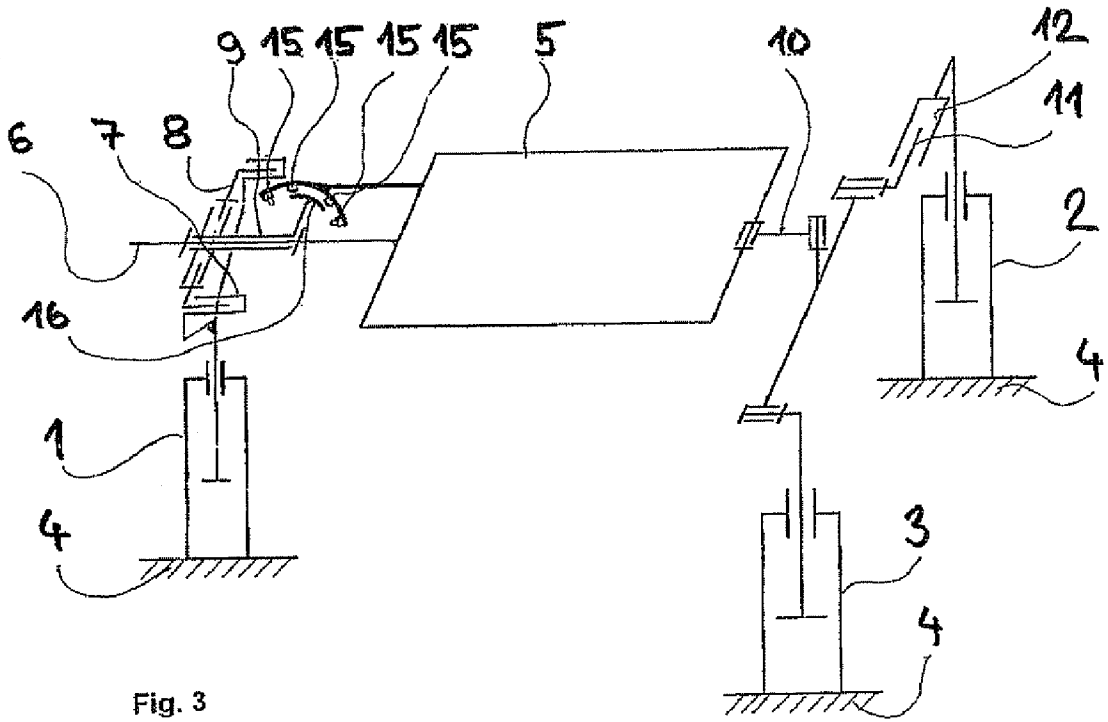
FIG. 3 is a kinematic diagram

At the beginning of the transversal tilt of the patient surface frame 5 the mutual position of the cam 16 and sensors 15 changes (see FIG. 3). In the first stage the two intermediate position sensors 15 indicate that the patient surface frame 5 has been tilted transversally and to which side. The achievement of the maximum tilt of the patient surface frame 5 to one or the other side is signalized by the two end position sensors 15.

Undesired forces that caused bending stress of the lifters 1, 2, 3 during the tilt of the patient surface frame 5 are minimized by movements of the sliders 8, 11 in the guides 7, 12.

The positioning mechanism in accordance with the invention is mainly used for hospital beds.

The invention claimed is:

1. A positioning mechanism of a bed comprising at least three height adjustable lifters arranged in a distance from each other that are mounted on an undercarriage frame at one side and connected to a patient surface frame at an opposite side, wherein a first lifter is arranged in such a way that its axis intersects the longitudinal axis of the patient surface frame and the first lifter is connected to the patient surface frame in a swinging way around the longitudinal axis of the patient surface frame and in a sliding way in the direction of the longitudinal axis of the patient surface frame while a second lifter and a third lifter are interconnected with an arm, oriented transversally to the longitudinal axis of the patient surface frame and the arm is connected to the patient surface frame in a swinging way while the arm is connected at one end to the second lifter both in a swinging way around an axis, which is parallel with the longitudinal axis of the patient surface frame and in a sliding way transversally to the patient surface frame and at the other end the arm is connected to the third lifter, in a swinging way around an axis, which is parallel with the longitudinal axis of the patient surface frame, and wherein the first lifter at its top end carries at least one horizontal first guide in which a first slider is mounted in a sliding way and the first slider is connected to a yoke in a swinging way while the yoke is connected to the patient surface frame in a swinging way whereas the second lifter carries at its top end at least one horizontal second guide in which at least one second slider is mounted in a sliding way that is connected with a pin to one end of the arm while the third lifter is connected to an opposite end of the arm with another pin.

2. The positioning mechanism of a bed in accordance with claim 1, wherein a distance between the axes of the pins arranged at opposite ends of the arm is bigger than a distance between the longitudinal axes of the second and third lifters.

3. The positioning mechanism of a bed in accordance with claim 1, wherein between the undercarriage frame and the patient surface frame, position sensors are arranged opposite a cam.

* * * * *